US008978738B2

(12) United States Patent
McQuillis et al.

(10) Patent No.: US 8,978,738 B2
(45) Date of Patent: Mar. 17, 2015

(54) CASTING DELIVERY NOZZLE

(71) Applicant: Nucor Corporation, Charlotte, NC (US)

(72) Inventors: Gary McQuillis, Blytheville, AR (US); Kevin Keown, Blytheville, AR (US); Eric Fulbright, Paragould, AR (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 14/290,202

(22) Filed: May 29, 2014

(65) Prior Publication Data

US 2014/0262117 A1 Sep. 18, 2014

Related U.S. Application Data

(62) Division of application No. 13/710,383, filed on Dec. 10, 2012, now Pat. No. 8,813,828.

(60) Provisional application No. 61/659,001, filed on Dec. 9, 2011.

(51) Int. Cl.
*B22D 11/06* (2006.01)
*B22D 11/103* (2006.01)

(52) U.S. Cl.
CPC ..... *B22D 11/0622* (2013.01); *B22D 11/0642* (2013.01); *B22D 11/103* (2013.01)
USPC ..... 164/428; 164/437; 164/480; 164/488

(58) Field of Classification Search
USPC ..... 164/428, 437, 480, 488; 222/606, 607
See application file for complete search history.

(56) References Cited

U.S. PATENT DOCUMENTS

| | | | |
|---|---|---|---|
| 2,128,941 | A | 9/1938 | Hudson |
| 3,991,815 | A | 11/1976 | Fastner et al. |
| 4,883,113 | A | 11/1989 | Matsui et al. |
| 5,178,205 | A | 1/1993 | Fukase et al. |
| 5,217,061 | A | 6/1993 | Yamauchi et al. |
| 5,221,511 | A | 6/1993 | Fukase et al. |
| 5,379,828 | A | 1/1995 | Blazek et al. |
| 5,494,095 | A | 2/1996 | Blazek et al. |
| 5,584,338 | A | 12/1996 | Freeman et al. |
| 5,840,206 | A | 11/1998 | Gacher et al. |

(Continued)

FOREIGN PATENT DOCUMENTS

| | | |
|---|---|---|
| EP | 0732163 | 9/1996 |
| EP | 2047925 | 4/2009 |

(Continued)

OTHER PUBLICATIONS

"Patent Cooperation Treaty PCT International Search Report", PCT/US12/68829, Mar. 8, 2013.

(Continued)

*Primary Examiner* — Kevin E Yoon
(74) *Attorney, Agent, or Firm* — Hahn Loeser + Parks LLP; Arland T. Stein

(57) ABSTRACT

In a twin roll continuous caster, the casting nozzle in the continuous casting apparatus is arranged such that the outlet passages and/or tapered walls in the main portion within the casting nozzle provide flow of molten metal downwardly converging toward the nip between the casting rolls of a twin roll caster. The casting nozzle having a reservoir portion for directing molten metal converging toward the triple point region to inhibit the washing of shells forming on the casting surfaces of the casting rolls.

19 Claims, 8 Drawing Sheets

(56) References Cited

U.S. PATENT DOCUMENTS

| | | | | |
|---|---|---|---|---|
| 6,012,508 | A * | 1/2000 | Folder | 164/480 |
| 6,073,680 | A * | 6/2000 | Folder | 164/480 |
| 6,092,700 | A | 7/2000 | Orihel et al. | |
| 6,095,233 | A | 8/2000 | Leabeater et al. | |
| 6,125,917 | A * | 10/2000 | Cassar et al. | 164/428 |
| 6,220,335 | B1 * | 4/2001 | Folder et al. | 164/437 |
| 6,889,749 | B2 | 5/2005 | Poloni et al. | |
| 7,757,747 | B2 | 7/2010 | McIntosh | |
| 7,926,549 | B2 | 4/2011 | Cooper et al. | |
| 2003/0201587 | A1 | 10/2003 | Ohtsuka et al. | |
| 2008/0264599 | A1 | 10/2008 | Blejde et al. | |
| 2009/0255644 | A1 | 10/2009 | Otsuka et al. | |
| 2009/0314458 | A1 | 12/2009 | Ondrovic et al. | |
| 2010/0230070 | A1 | 9/2010 | Bowman et al. | |
| 2011/0132568 | A1 | 6/2011 | Schlichting et al. | |

FOREIGN PATENT DOCUMENTS

| | | |
|---|---|---|
| GB | 549327 | 11/1942 |
| GB | 1278624 | 6/1972 |
| GB | 2273068 | 8/1994 |
| WO | 2008086580 | 7/2008 |
| WO | 2010034084 | 4/2010 |

OTHER PUBLICATIONS

"Australian Patent Office International-Type Search Report", National Application No. 2012900332, Mar. 22, 2012.

* cited by examiner

CASTING DELIVERY NOZZLE

RELATED APPLICATIONS

This application is a divisional of U.S. patent application Ser. No. 13/710,383, filed Dec. 10, 2012, which claims priority to and the benefit of U.S. Provisional Patent Application No. 61/569,001, filed Dec. 9, 2011, which is incorporated herein by reference.

BACKGROUND AND SUMMARY

This invention relates to making thin strip and more particularly casting of thin strip by a twin roll caster.

It is known to cast metal strip by continuous casting in a twin roll caster. Molten metal is introduced between a pair of counter-rotating horizontal casting rolls, which are cooled so that metal shells solidify on the moving roll surfaces and are brought together at the nip between the rolls to produce solidified strip product delivered downwardly from the nip between the rolls. The term "nip" is used herein to refer to the general region at which the rolls are closest together. The molten metal may be poured from a ladle into a smaller vessel, or tundish, from which it flows through a metal delivery nozzle positioned above the nip, longitudinally between the casting rolls, which delivers the molten metal to the region above the nip to form a casting pool of molten metal. The casting pool of molten metal is supported on the casting surfaces of the rolls above the nip. The casting pool is typically confined at the ends of the casting rolls by side plates or dams held in sliding engagement adjacent the ends of the casting rolls.

In casting thin strip by twin roll casting, the metal delivery nozzles receive molten metal from the moveable tundish and deposit the molten metal in the casting pool in a desired flow pattern. The flow pattern created by the manner in which the nozzle delivers molten metal to the casting pool can affect the quality and yield of the thin strip. For example, a flow pattern which causes thinning of the shells on the surface of the casting rolls before coming together at the nip is believed to cause ridges to be formed on the surface of the strip. A flow pattern which inhibits thinning of the shells on the casting roll would reduce such surface defects. Further, disturbance of the surface, or meniscus, of the casting pool has a tendency to cause meniscus marks on the surface of the strip. A flow pattern which inhibits disturbance of the surface of the casting pool is more likely to provide a metal strip with fewer meniscus marks and provide a better quality and improved yield of product.

The formation of pieces of solid metal known as "skulls" in the casting pool in the vicinity of the confining side plates or dams is a known problem. The rate of heat loss from the casting pool is higher near the side dams adjacent the casting roll ends due to the greater surface area of continuous caster components in contact with the molten metal in the casting pool increasing the conductive heat loss from the system. This area is called the "triple point region." This localized heat loss gives rise to "skulls" of solid metal forming in that region, which can grow to considerable size. The skulls can drop through the nip of the casting rolls and into the forming strip, causing defects in the strip known as "snake eggs." An increased flow of molten metal to the triple point regions, near the side dams, has been provided to help maintain the temperature of the casting pool in these regions. Examples of such proposals may be seen in U.S. Pat. No. 4,694,887 and in U.S. Pat. No. 5,221,511, which are both incorporated herein by reference. However, in providing increased flow in these regions it is important that the surface of the casting pool is disturbed as little as possible. Further, it is important to inhibit thinning of the shells on the surface of the casting roll in the triple point region to reduce surface defects in the strip. Also, it is important that the shells are not washed on the casting surfaces of the rolls in the triple point region, increasing the possibility of defects in the strip and reducing the quality and yield of the strip product.

The present disclosure provides a method for continuously casting metal strip, which comprises the steps of:

(a) assembling a pair of casting rolls laterally positioned to form a nip between them and to maintain a casting pool of molten metal supported by the casting rolls between side dams, (b) assembling an elongated metal delivery nozzle extending along and above the nip, the delivery nozzle having one or more segments extending longitudinally along the metal delivery nozzle, each segment having:

a main portion having one or more outlets positioned longitudinally along the elongated metal delivery nozzle and adapted to deliver molten metal downwardly converging toward the nip while forming the casting pool supported on the casting rolls above the nip, and an end portion adjacent a side dam having a reservoir portion having at least one pair of passages adapted to deliver molten metal into the casting pool adjacent the side dams the flow from the at least one pair of passages converging beneath the reservoir portion, (c) delivering molten metal from a metal delivery system to the main portion of the segments to deliver molten metal through the one or more outlets converging downwardly toward the nip, while forming the casting pool of molten metal supported on the casting rolls above the nip, and through the at least one pair of passages in the reservoir portion in the end portions into the casting pool adjacent the side dams, and (d) counter-rotating the casting rolls to form shells on the casting surfaces of the casting rolls brought together at the nip to cast metal strip downwardly from the nip.

Also disclosed is an apparatus for continuously casting metal strip, comprising:

(a) a pair of casting rolls laterally positioned to form a nip between them and side dams to form a molten metal pool supported by the casting rolls between side dams and adapted to counter rotate to form shells on the casting rolls brought together at the nip to cast metal strip downwardly from the nip;

(b) an elongated metal delivery nozzle extending along and above the nip, the delivery nozzle having one or more segments each having:

a main portion extending along the elongated metal delivery nozzle with one or more outlets positioned longitudinally along the elongated metal delivery nozzle and directed converging downwardly toward the nip while forming a casting pool of molten metal supported on the casting rolls above the nip, and an end portion adjacent side dams having a reservoir portion having at least one pair of passages adapted to deliver molten metal into a molten metal pool adjacent the side dams with flow from the at least one pair of passages converging below the reservoir portion; and, (c) a metal delivery system adapted to introduce molten metal through the segments of the elongated metal delivery nozzle downwardly converging toward the nip.

In some alternatives of the above method and apparatus, the end portion of each segment has a laterally extending weir adapted to allow molten metal to flow over the weir between the reservoir portion and the main portion. Optionally in addition, or in the alternative, the main portion of each segment extends beneath the reservoir portion into the end portion.

In other alternatives of the above method and apparatus, the outlets in the main portion of each segment are in a pair of rows of outlets and deliver molten metal with flow from each row of outlets converging toward flow from the outlets of the other row. The pair of rows of outlets in the main portion of each segment may be angled such that their directions of flow converge below the delivery nozzle. In other alternatives, the outlets in the main portion of each segment may be configured to flow downwardly at an angle between 5 and 60 degrees substantially centered about a vertical centerline through the elongated delivery nozzle. Additionally, the at least one pair of passages in the reservoir portion of each segment may be angled such that their directions of flow converge below the reservoir portion. The passages of the at least one pair of passages in the reservoir portion of each segment may be positioned between 40 and 160 millimeters apart, or, alternatively, between 50 and 125 millimeters apart. Furthermore, the at least one pair of passages in the reservoir portion may have an angle of convergence between 5 and 60 degrees substantially centered about a vertical centerline through the elongated delivery nozzle.

In further alternatives of the above method and apparatus, the one or more outlets may be a channel extending longitudinally along each segment. The channel may have substantially parallel sides, or, in the alternative, the channel may have tapered sides.

The delivery nozzle of the above method and apparatus may further comprise a restrictive baffle in the main portion adapted to cause the molten metal to flow laterally within the delivery nozzle. In other alternatives the baffle may be adapted to support a pool of molten metal in the main portion of the delivery nozzle. The baffle may be adapted to reduce the velocity of the molten metal passing through the delivery nozzle, and optionally may have a convex or concave portion adapted to reduce the velocity, or change the direction, of the molten metal passing through the delivery nozzle.

The main portion of the delivery nozzle may comprise one or more passages above the one or more outlets, adapted to deliver molten metal to the outlets, and, optionally, the bottom portion of the main portion of the delivery nozzle may be tapered toward the one or more passages to converge the molten metal flow toward the nip between casting rolls of a twin roll caster. Alternatively, the bottom portion of the main portion of the delivery nozzle may be tapered toward the one or more outlets to converge the molten metal flow toward the nip between casting rolls.

Also disclosed is a method of continuously casting metal strip comprising:

(a) assembling a pair of casting rolls laterally positioned to form a nip between them and adapted to maintain a casting pool of molten metal supported by the casting rolls adjacent side dams, (b) assembling an elongated metal delivery nozzle extending along and above the nip, the delivery nozzle having:

at least one segment having a main portion, the main portion having one or more outlets adapted to deliver molten metal in the casting pool longitudinally along the metal delivery nozzle directed downwardly toward the nip; and, a restrictive baffle, positioned above the outlets adapted to alter the velocity of the molten metal flowing through the main portion of delivery nozzle and tapered sidewalls and/or passages below the baffle enables molten metal to flow below the baffle to converge toward the nip, (c) introducing molten metal from a metal delivery system through the elongated metal delivery nozzle downwardly toward the nip forming a casting pool of molten metal supported on the casting rolls above the nip, and (d) counter-rotating the casting rolls so as to form shells on the casting surfaces of the casting rolls brought together at the nip to cast metal strip downwardly from the nip.

Additionally disclosed is an apparatus for continuously casting metal strip comprising:

(a) a pair of casting rolls laterally positioned to form a nip between them and adapted to maintain a casting pool of molten metal supported by the casting rolls between side dams- and adapted to counter rotate to form shells on the casting rolls brought together at the nip to cast metal strip downwardly from the nip, (b) an elongated metal delivery nozzle extending along and above the nip, the delivery nozzle having:

at least one segment having a main portion, the main portion having one or more outlets positioned along the delivery nozzle adapted to deliver molten metal in the casting pool longitudinally along the metal delivery nozzle directed downwardly converging toward the nip; and a restrictive baffle positioned above the outlets adapted to alter the velocity of the molten metal flowing through the main portion of the delivery nozzle and downwardly in the delivery nozzle; and, (c) a metal delivery system for introducing molten metal through the segments of the elongated metal delivery nozzle downwardly converging toward the nip.

In some embodiments of the above method and apparatus, the elongated delivery nozzle has segments positioned end to end adapted to deliver molten metal in the casting pool along the metal delivery nozzle directed downwardly converging toward the nip.

The elongated metal delivery nozzle of the above method and apparatus for continuously casting metal strip may also comprise an end portion adjacent side dams having a reservoir portion having at least one pair of passages adapted to deliver molten metal into a molten metal pool adjacent side dams, the directions of flow to converge below the reservoir portion. The entries of each passage of the at least one pair of passages in the reservoir portion may be positioned between 40 and 160 millimeters apart, or between 55 and 125 millimeters apart, and may have an angle of convergence between 5 and 60 degrees substantially centered about a vertical centerline through the elongated delivery nozzle. Optionally in addition, or in the alternative, the reservoir portion in the end portion of each segment may have a laterally extending weir adapted to allow molten metal to flow over the weirs between the main portion and the reservoir portion. The main portion may extend beneath the reservoir portion into the end portion of each segment.

The baffle may comprise one or more passages adapted to allow molten metal to flow through the passages. The baffle may be adapted to cause the molten metal to flow laterally within the main portion of the delivery nozzle. In addition, or in the alternative, the baffle may be adapted to reduce the velocity of the molten metal flowing through the elongated delivery nozzle. The baffle may be adapted such that a pool of molten metal is formed in the main portion of the delivery nozzle above the baffle. Further, in some alternatives, the baffle may be removable from each segment of the elongated delivery nozzle.

In some embodiments, the one or more outlets in the main portion of the elongated metal delivery nozzle may be one or more pairs of rows of outlets positioned longitudinally along the elongated metal delivery nozzle directed downwardly toward the nip such that the directions of flow of the pair of outlets converge below the delivery nozzle. The at least one pair of outlets may be angled such that their directions of flow converge below the reservoir portion. The angle of convergence of the outlets may be between 5 and 60 degrees substantially centered about a vertical centerline through the elongated delivery nozzle.

In some alternatives, the one or more outlets in the main portion of each segment is at least one channel extending longitudinally along each segment. The channel may have substantially parallel sides, or, in the alternative, the channel may have tapered sides. The main portion may further comprise one or more passages above the channel, adapted to deliver molten metal to the channel. In embodiments, the one or more passages may be positioned below the baffle. In addition, or in the alternative, the main portion may be tapered toward the one or more passages. In addition, or in the alternative, the bottom portion of the main portion may be tapered toward the one or more outlets.

Various aspects of the invention will be apparent from the following detailed description, drawings and claims.

BRIEF DESCRIPTION OF THE DRAWINGS

The invention is described in more detail in reference to the accompanying drawings in which.

DETAILED DESCRIPTION

Disclosed are methods and apparatuses of continuously casting metal strip. Such methods include the steps of assembling a pair of casting rolls laterally disposed to form a nip between them and to maintain a casting pool of molten metal supported by the casting rolls between the side dams, assembling an elongated metal delivery nozzle extending along and above the nip, the delivery nozzle having one or more segments extending longitudinally along the metal delivery nozzle, each segment having a main portion having one or more outlets positioned longitudinally along the elongated metal delivery nozzle and directed downwardly converging toward the nip while forming the casting pool supported on the casting rolls above the nip. The outlets may be positioned as a pair of rows of outlets longitudinally throughout the main portion of the delivery nozzle. The angle of convergence between one row of outlets and the other row of outlets may be such that the direction of flow of molten metal from each row converges, or converges above, at, or virtually below the nip as described in detail below. Alternatively, the outlets may be one or more channels extending longitudinally throughout the main portion of the delivery nozzle.

The delivery nozzle may have an end portion adjacent a side dam having a reservoir portion having at least one pair of passages adapted to deliver molten metal into the casting pool adjacent the side dams the flow from the at least one pair of passages converging beneath the reservoir portion. Alternatively, each segment may have an end portion adjacent a side dam having a reservoir portion having at least one pair of passages to deliver molten metal into the casting pool adjacent the side dams the flow from the at least one pair of passages converging beneath the reservoir portion. Further, the methods may include the steps of delivering molten metal from a metal delivery system to the main portion of the segments to deliver molten metal through outlets converging downwardly toward the nip while forming the casting pool of molten metal supported on the casting rolls above the nip, and through the at least one pair of passages in the reservoir portion in the end portions converging downwardly into the casting pool adjacent the side dams, and counter rotating the casting rolls so as to form shells on the casting surfaces of the casting rolls brought together at the nip to cast metal strip downwardly from the nip. Also disclosed are methods for continuously casting metal strip where the delivery nozzle has a baffle within the main portion of the delivery nozzle. The baffle may be positioned above the outlets to alter the velocity of the molten metal flowing through the outlet.

Figure 1A:
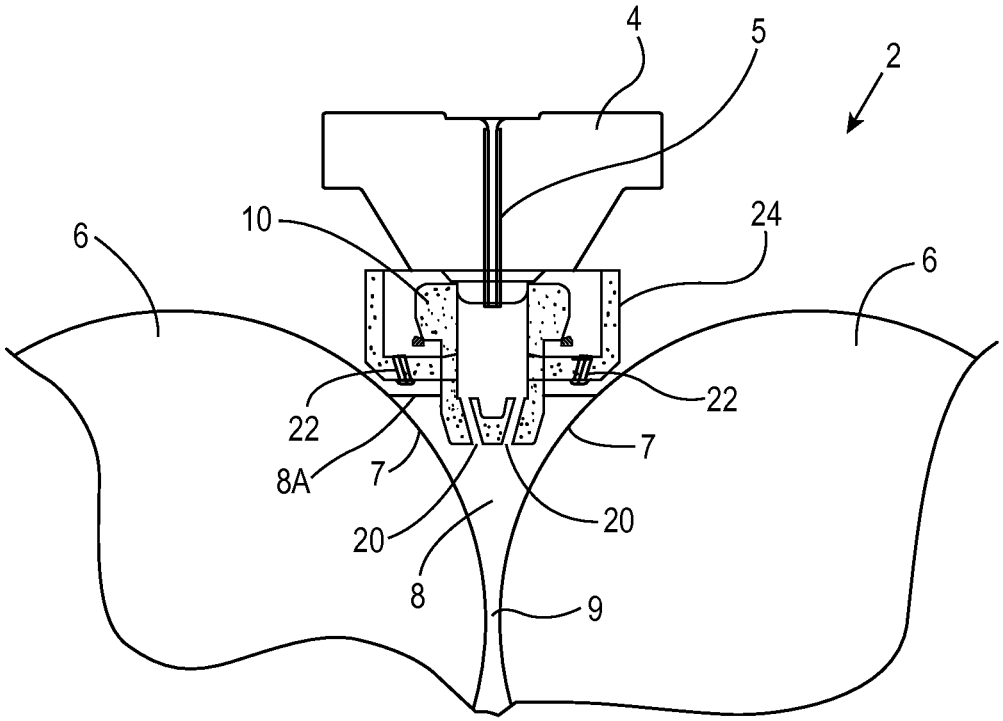
FIG. 1A illustrates a cross-sectional end view of a portion of the twin roll strip caster with an assembled metal delivery nozzle.
Figure 1B:
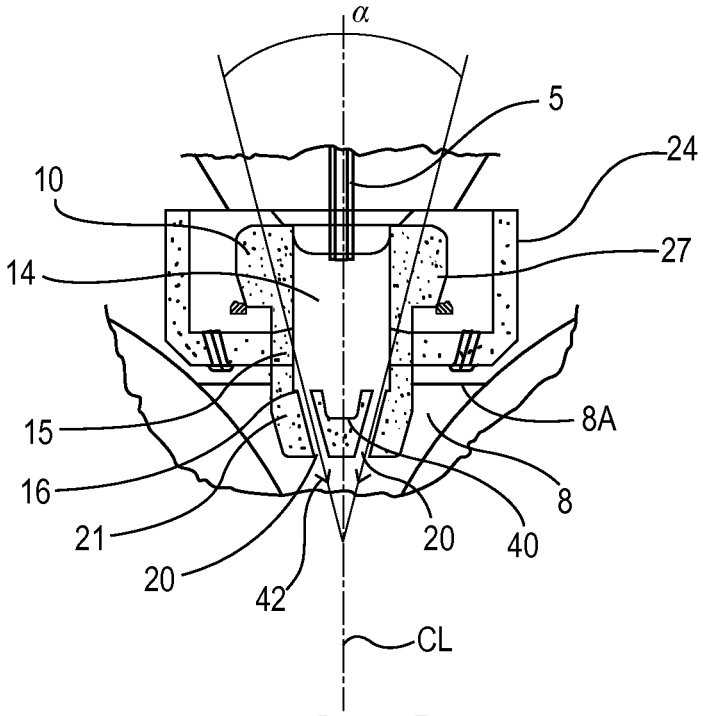
FIG. 1B is an enlarged cross-sectional end view of a metal delivery nozzle for use in the twin roll caster shown in FIG. 1A.
Figure 2:
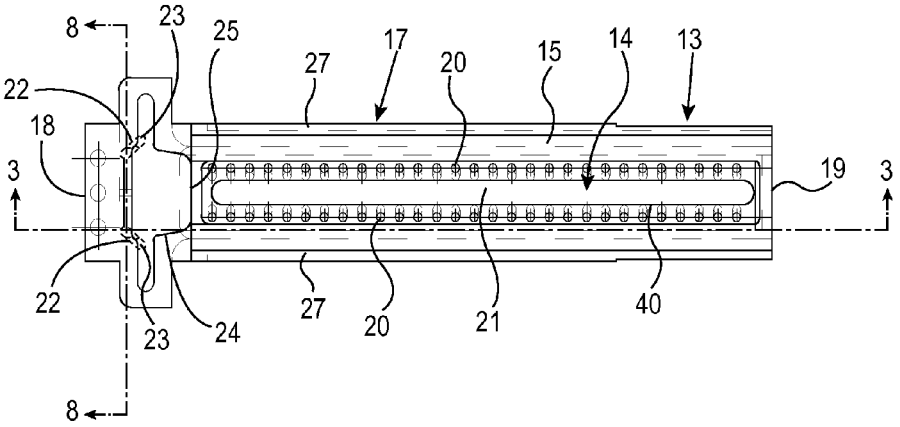
FIG. 2 is a plan view of a segment of a metal delivery nozzle for use with the twin roll caster of FIG. 1A.

Referring to FIGS. 1A, 1B, and 2, the metal strip casting apparatus 2 includes a metal delivery nozzle 10 having one or more segments 13 extending longitudinally along the metal delivery nozzle 10 located below a portion of the metal distributor 4 (the metal distributor also called a moveable tundish or transition piece) and above casting rolls 6. Casting rolls 6 are laterally positioned to form a nip 9 between them, maintaining a casting pool 8 between them. FIGS. 1A and 1B show the metal delivery nozzle 10 being positioned above the nip 9 of the casting rolls 6, maybe symmetrically about the longitudinal centerline CL of the casting apparatus 2. The metal distributor, or tundish, receives molten metal from a ladle through a metal delivery system (not shown) and delivers the molten metal through a nozzle in the lower portion 4 of the metal distributor to the delivery nozzle 10. A passage 5 may extend from a portion of the metal distributor 4 and into delivery nozzle 10, for the purpose of transferring molten metal into the segments of the delivery nozzle 10. Alternatively, the metal distributor may transfer molten metal to the segments of delivery nozzle 10 via a hole in the bottom portion 4 of metal distributor. Below delivery nozzle 10, a casting pool 8 having surface 8A is formed supported on the casting surfaces 7 of casting rolls 6 adjacent nip 9. Casting pool 8 is constrained at the ends of casting rolls by side dams or plates (not shown) positioned against the sides of the casting rolls 6. The segments 13 of the delivery nozzle 10 extend into and are partially submerged in casting pool 8 during the casting campaign.

The delivery nozzle 10 may include segments 13 each supported to receive molten metal from the bottom portion of the metal distributor 4. Each segment 13 has an upward opening inner trough 14 to receive and hold molten metal flowing from the bottom portion of the metal distributor 4 through passage 5. As shown, the inner trough 14 is bounded by sidewalls 15 and bottom portion 21 of the delivery nozzle 10. The flow of molten metal from the inner trough 14 of each segment 13 is directed through passages 16 in the bottom portion 21 of the casting nozzle 10, out of outlets 20 and into the casting pool 8. The velocity of the molten metal through the casting nozzle 10 may be impeded by an impact pad 40. The reduction in the vertical velocity of the molten metal affecting the flow distribution of molten metal in the casting nozzle 10, reducing the velocity of the molten metal at the outlets 20.

As shown in FIGS. 1A, 1B, and 2, an elongated delivery nozzle 10 is assembled, extending along and above the nip 9, having at least one segment 13 having a main portion 17, the main portion 17 having outlets 20 positioned along the delivery nozzle 10 adapted to deliver molten metal in the casting pool 8 longitudinally along the metal delivery nozzle 10 directed downwardly converging toward the nip 9. The delivery nozzle may have an impact pad 40 which may be positioned above the passages 16, having outlets 20, to alter the velocity of the molten metal flowing through the nozzle 10. The impact pad 40 may be adapted such that a pool of molten metal is formed in the delivery nozzle 10 above the impact pad 40. The impact pad 40 may be shaped such as to have side-walls forming a trough along the bottom portion 21 of the segment 13 of the nozzle 10 such as to form a pool of molten metal along the bottom surface of the inner trough 14 of the nozzle segment 13. The molten metal being delivered from the bottom portion of the metal distributor 4 via the passage 5 into the casting nozzle 10 and contacting the impact pad 40. In some embodiments, the impact pad 40 may be concave in shape, having a similar effect as the trough-shaped impact pad described above, while having a continuous contour, avoiding eddying of the molten metal, which may occur in the corners of the trough-shaped impact pad 40. Alternatively the impact pad 40 may be convex in shape, diverting the molten metal laterally toward the sidewalls 15 of the core nozzle segment 13, or the impact pad 40 may be substantially planar, retarding the flow and altering the direction of the molten metal to control the flow-rate of the molten metal exiting the nozzle 10 at the outlets 20.

In some embodiments, the impact pad 40 may be positioned symmetrically about the longitudinal centerline CL of the delivery nozzle 10, as shown in FIGS. 1A and 1B. The impact pad 40 may be adapted to divert the molten metal laterally and/or longitudinally within the nozzle 10, directing the molten metal toward the ends 18 and the sidewalls 15 of the casting nozzle 10. Alternatively or additionally, the impact pad 40 may be adapted to reduce the velocity of the molten metal as it flows through the casting nozzle 10. In each embodiment, the impact pad 40 will affect the velocity of the molten metal flowing through the casting nozzle 10. The velocity of the molten metal having components of speed and direction, the impact pad 40 will impact the speed and/or direction of the molten metal.

With the prior art metal delivery nozzles, the liquid metal exiting the nozzle outlets tends to flow in a direction that is generally directed toward the surface of the rolls. It has been discovered that in this instance the liquid metal flowing from the nozzle and impacting the surface 7 of the rolls 6 may retard shell growth rate, relative to the cooler undisturbed liquid metal of the pool 8, and may even reduce shell thickness in localized areas. Thinner shells in these localized areas may allow bulging below the nip and create a ridge profile on the strip. This phenomenon is known as shell washing, and it is desirable to inhibit the washing of shells on the casting roll surface 7.

The metal strip casting apparatus 2 for continuously casting strip comprises a pair of casting rolls 6 laterally positioned to form a nip 9 between them and adapted to form a molten metal pool 8 supported by the casting rolls 6 between side dams (not shown). An elongated metal delivery nozzle 10 extending along and above the nip 9, the delivery nozzle 10 having one or more segments 13 each having a main portion 17 extending along the elongated metal delivery nozzle 10 with outlets 20 positioned longitudinally along the elongated metal delivery nozzle 10 directed downwardly and converging toward the nip 9 while forming a casting pool 8 of molten metal supported on the casting rolls 6 above the nip 9. The molten metal having a flow directed downwardly converging toward the nip 9 to inhibit washing of the shells forming on the casting rolls 6. In other embodiments, the apparatus 2 may be comprised of an elongated metal delivery nozzle 10 extending along and above the nip 9, the delivery nozzle 10 having at least one segment 13 each having a main portion 17 having at least one pair of outlets 20 positioned longitudinally along the metal delivery nozzle 10 adapted to deliver molten metal in the casting pool 8 longitudinally directed downwardly toward the nip 9, converging below the main portion 17.

The main portion 17 of each segment 13 of the casting nozzle 10 having a pair of rows of passages 16, the passages 16 having outlets 20, positioned longitudinally along the elongated metal delivery nozzle 10, directed downwardly toward the nip 9 so as to inhibit the washing of shells forming on the casting rolls 6. In some embodiments, the outlets 20 in the main portion 17 of each segment 13 may be arranged in a pair or rows of outlets 20 and deliver molten metal with flow 42 from each row of outlets 20 converging toward flow 42 from the other row of outlets 20. The angle of convergence $\alpha$, of the directions of flow 42, may be such that the directions of flow 42 from the pair of outlets 20 converge within the casting pool 8, above the nip 9, at the nip 9, or virtually at some position below the nip 9.

The pair of rows of outlets 20, of passages 16, in the main portion 17 of each segment 13 may be arranged at an angle $\alpha$ not less than 5 and not greater than 60 degrees substantially centered about a vertical centerline CL through the elongated delivery nozzle 10, or alternatively, the angle $\alpha$ may be up to, or exceed, 120 degrees substantially centered about the vertical centerline CL. In some embodiments, for example, each of the outlets 20, in the main portion 17 of each segment 13, may be arranged at an angle $\alpha$ of approximately 32 degrees substantially centered about vertical centerline CL through the elongated delivery nozzle 10. The pair of rows of outlets 20 in the main portion 17 of each segment 13 may be angled such that their directions of flow converge below the delivery nozzle 10. Furthermore, the outlets 20 of the main portion 17 may be arranged substantially symmetrically about the vertical centerline CL of the casting apparatus 2. The passages 16 may comprise parallel side walls; alternatively, the sidewalls of the passages 16 may be flared or narrowed to control the flow of the molten metal as desired. Also, the passages 16 may be curved or may change direction to further control the flow of the molten metal being delivered to the casting pool 8 as desired. Each passage 16 may be a round passage through the bottom portion 21 of the nozzle 10, or alternatively, each passage 16 may be an oblate passage through the bottom part 21 of the nozzle 10, with the greater dimension orientated generally along the longer dimension of the nozzle 10. Also, the passages 16 may be oblate passages arranged laterally in the casting nozzle 10, which may have angled side walls such as to direct the flow of the molten metal downwardly in the casting pool 8, toward the nip 9.

Figure 3A:
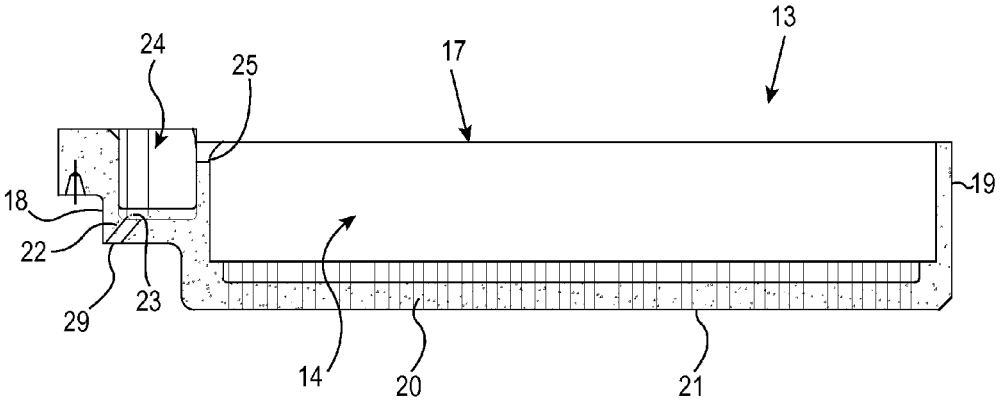
FIG. 3A is a cross-sectional transverse side view of a metal delivery nozzle for use in the twin roll caster shown in FIG. 1A, taken along the line 3-3 of the metal delivery nozzle of FIG. 2.
Figure 3B:
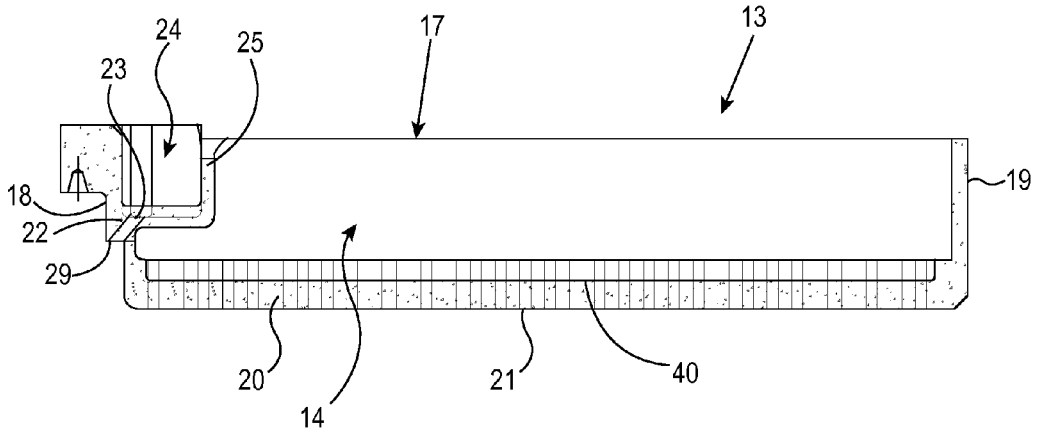
FIG. 3B is a cross-section transverse side view of a metal delivery nozzle for use in the twin roll caster shown in FIG. 1A, taken along the line 3-3 of the metal delivery nozzle of FIG. 2, where the main portion extends below the reservoir portion.
Figure 10:
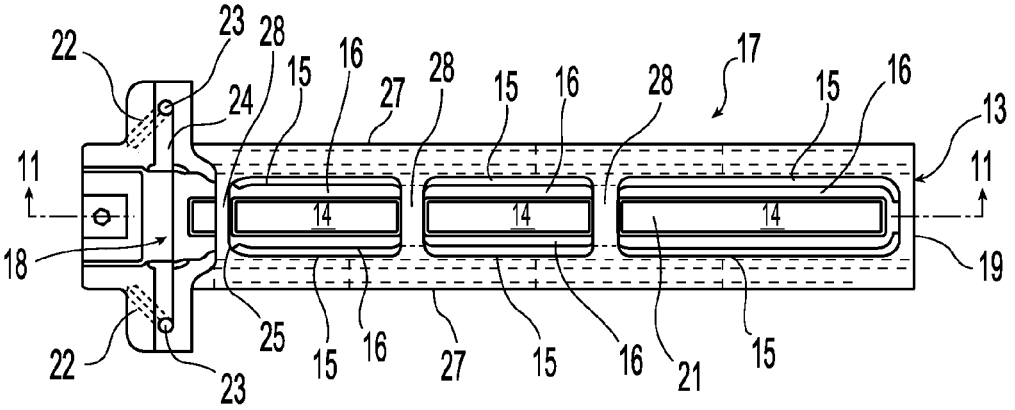
FIG. 10 is a plan view of an alternative segment of a metal delivery nozzle for use in the twin roll caster shown in FIG. 1A.
Figure 11:
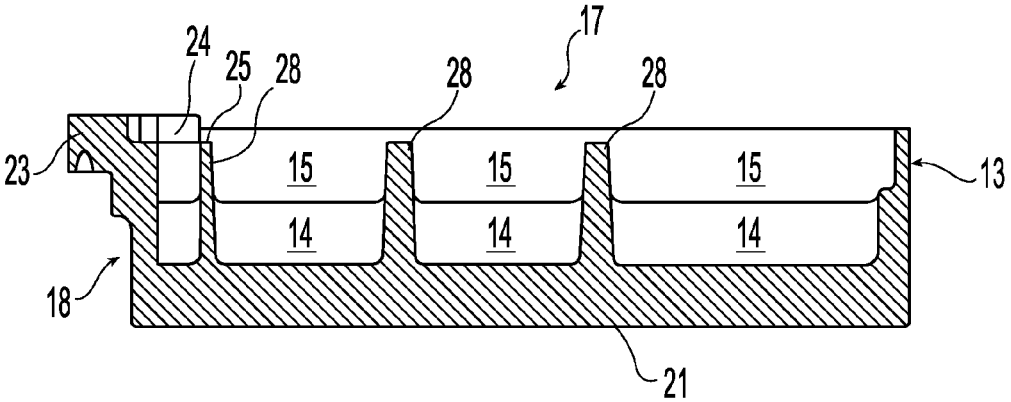
FIG. 11 is a cross-sectional transverse taken along the line 11-11 of the delivery nozzle segment shown in FIG. 10.

Referring to FIGS. 2, 3A, and 3B, the delivery nozzle 10 is comprised of two segments 13 with segment end walls 19 positioned adjacent, but spaced from each other. The inner trough 14 of each segment 13 extends lengthwise through the main portion 17 and into end portion 18. The inner trough 14 may be formed of the segment side walls 15 with shoulder portions and joined to at bottom portion 21 of the segment 13. Shoulder portions may be positioned along each side of the inner trough 14, through which may be passages 16 having outlets 20, described above. Alternatively the inner trough 14 may not comprise of shoulder portions. The inner trough 14 may extend from the end wall 19 through the main portion 17 to an opposite end wall in the end portion 18. The molten metal flows from the inner trough 14 through the passages 16, for example, to the outlets 20 in the bottom portion 21. If present, the shoulder portion may provide structural support to the segment 13 when the delivery nozzle 10 is loaded with molten metal during a casting campaign. In such an embodiment, partitions 28, as shown in the alternative embodiment described below with reference to FIGS. 10 and 11, are not needed to provide structural support for the segment 13 when loaded with molten metal. As a result, the flow of molten metal from the outlets 20 into the casting pool 8 may be provided more laterally and more evenly along each segment 13.

In operation, molten metal is poured from the metal distributor 4 through passage 5 into the inner trough 14 of the segments 13 of the delivery nozzle 10. Several passages 5 may be provided along the length of the segments 13 of the delivery nozzle 10. The molten metal flows from the inner trough 14 into the passages 16, described above, and through the outlets 20 into the casting pool 8. In some alternative embodiments, passage 16 may be shortened, changed, or be unnecessary, as desired, to provide flow of molten metal from the inner trough 14 to the outlets 20. In any case, the outlets 20 are shaped such that they direct molten metal downwardly toward the nip 9. The casting delivery nozzle 10 may comprise two rows of outlets 20 longitudinally distributed along the length of the casting nozzle 10, typically substantially equidistant from the longitudinal centerline CL of the casting apparatus 10.

The casting rolls 6 are cooled such that heat is transferred from the molten metal in the casting pool 8 adjacent the casting surfaces 7 of the casting rolls 6 into the casting rolls 6. The cooling of the molten metal causes shells of solid or solidifying metal to form on the casting surfaces 7 of the casting rolls 6. The casting rolls 6 are counter-rotated so as to continually form shells on the casting surfaces 7 of the casting rolls 6 and so that the shells are brought together at the nip 9 to cast metal strip downwardly from the nip 9.

As shown in FIGS. 2, 3A, and 3B, the inner trough 14 extends substantially between the end wall 19 of the segment 13 through the main portion 17 and into the end portion 18. Thus, the passages 16 and outlets 20 may extend substantially along the length of the segment 13, and may extend through most of the end portion 18 if desired. The elongated metal delivery nozzle 10 extending along and above the nip 9, may have one or more segments 13 each having an end portion 18 adjacent side dams (not shown) having a reservoir portion 24 having at least one pair of passages 22 adapted to deliver molten metal into the molten metal pool 8 adjacent the side dams (not shown) with flow 42 from the at least one pair of passages 22 converging below the reservoir portion 24. In the embodiment shown in FIG. 3A, the inner trough 14 extends into the end portion 18 of the segment 13. In FIG. 3B the main portion 17 and the inner trough 14, of each segment 13, extend beneath the reservoir portion 24 into the end portion 18. By extending the inner trough 14 and corresponding outlets 20 substantially along the bottom length of the segment 13, the flow of molten metal may be increased adjacent the segment end portion 18 into the "triple point" region. By this arrangement, more uniform flow of molten metal may be delivered to the casting pool 8 in the area adjacent the ends of the casting rolls 6, thereby inhibiting washing of the shells on the casting rolls 6. The passages 16 and outlets 20 in the main portion 17 of the delivery nozzle 10 under the reservoir portion 24 may be arranged such that their direction of flow 42 is directed toward the triple-point region in order to increase the flow of molten metal to the triple-point region, while inhibiting the washing of shells from the casting surfaces 7 of the casting rolls 6.

Figure 4:
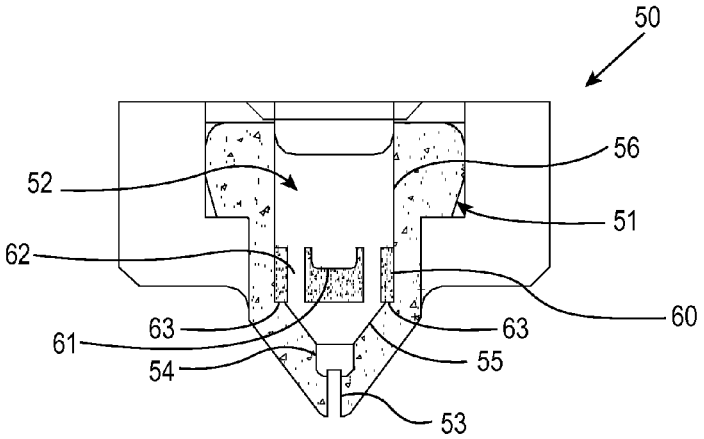
FIG. 4 illustrates a cross-sectional end view of an alternative metal delivery nozzle for use with a twin roll caster.

Referring to FIG. 4, illustrated is a cross-sectional end view of an alternative metal delivery nozzle 50 for use with a twin roll caster. The elongated metal delivery nozzle 50 has at least one segment 51 having a main portion 52. The main portion 52 of the delivery nozzle 50 may have a channel 53 disposed along the delivery nozzle 50, longitudinally over the nip (not shown) adapted to deliver molten metal in the casting pool longitudinally along the metal delivery nozzle 50, toward the nip. The channel 53 may have substantially parallel sides, as shown with the convergence toward the nip within the nozzle 50 by channel 53 shaped to focus the molten metal toward the nip. Alternatively, the channel 53 may have tapered sides and be configured to converge and direct the molten metal at the nip. The tapered sides of the channel 53 may taper upwardly and outwardly.

Figure 5:
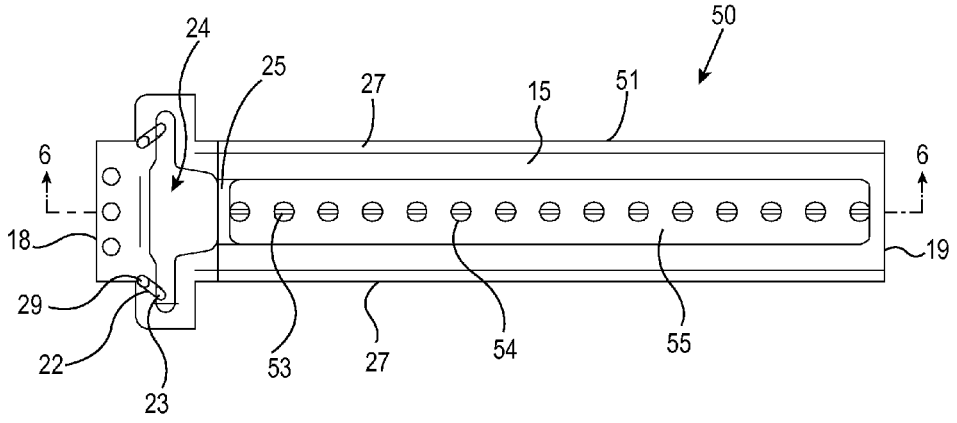
FIG. 5 is a plan view of a segment of a metal delivery nozzle for use with the twin roll caster of FIG. 4.

With reference to FIG. 5, the delivery nozzle 50 is shown without restrictive baffle 60 for clarity. One or more passages 54 are longitudinally disposed along the bottom portion 55 of the main portion 52 of the delivery nozzle segment 51, above the channel 53. The passages 54 are adapted to deliver molten metal from the main portion 52 to the channel 53 to deliver molten metal toward the nip. Each passage 54 in the bottom portion 55 of the nozzle segment 51 may be discrete. In alternative embodiments, the bottom portion 55 of the nozzle segment 51 may comprise a single passage 54, adapted to deliver molten metal to the channel 53, along the length of the channel 53. The bottom portion 55 of the delivery nozzle segment 51 is tapered to converge the metal flow toward the passages 54, such that the molten metal is directed to travel downwardly and inwardly toward the passages 54, and through the channel 53 directed toward the nip portion. In alternative embodiments, without passages 54, the bottom portion 55 of the delivery nozzle segment 51 may be tapered to converge the flow of molten metal toward and through the channel 53 toward the nip portion.

Figure 6:
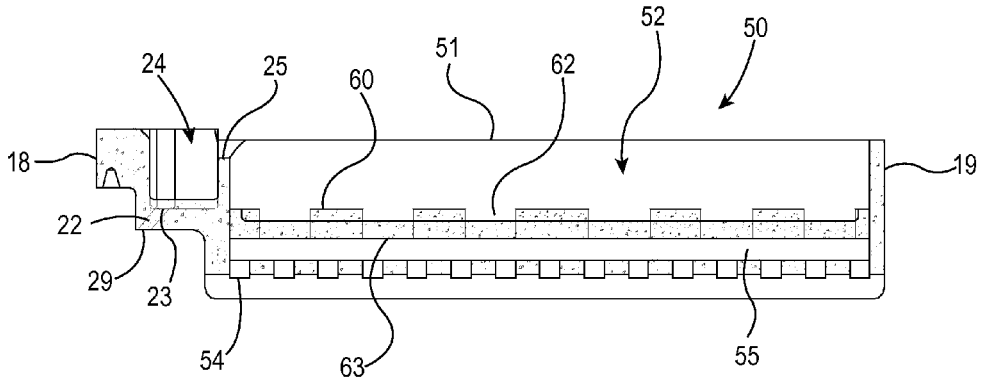
FIG. 6 is a cross-sectional transverse side view of a metal delivery nozzle for use in the twin roll caster shown in FIG. 4, taken along the line 6-6 of the metal delivery nozzle of FIG. 5.
Figure 7:
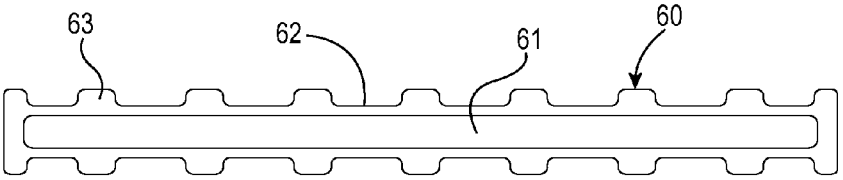
FIG. 7 is a plan view of a baffle for use with the metal delivery nozzle of FIG. 5.

FIGS. 4 and 6 show, in the main portion 52 of the delivery nozzle segment 51, a baffle 60. FIG. 7 shows the baffle 60 out of the delivery nozzle 50. FIG. 6 is a cross-section of FIG. 5 but with restrictive baffle 60 in position. The baffle 60 is positioned above the channel 53 between a bottom portion 55 and a top portion 56 of the main portion 52 of the delivery nozzle segment 51. The baffle 60 may extend longitudinally within the main portion 52 of the delivery nozzle segment 51, as shown in FIG. 6. Alternatively, the baffle 60 may partially extend longitudinally within the main portion 52 of the delivery nozzle segment 51. The baffle 60 may be adapted to alter the velocity of the molten metal travelling through the main portion 52 of the delivery nozzle 50 and provide convergent flow of metal toward the nip internal of the delivery nozzle 50. In some embodiments the baffle 60 may be adapted to reduce the velocity of the molten metal flowing through the main portion 52 of the delivery nozzle 50.

The baffle 60, may comprise a concave portion 61 adapted to support a pool of molten metal within the main portion 52 of the delivery nozzle segment 51. In alternative embodiments, the baffle 60 may comprise a convex portion adapted to laterally divert the molten metal within the main portion 52 of the delivery nozzle segment 51, changing the velocity of the molten metal passing through the nozzle 50. The baffle 60 may comprise one or more passages 62 adapted to allow molten metal through the passages 62, delivering molten metal from the top portion 56 to the bottom portion 55 of the metal delivery nozzle segment 51 converging toward the nip.

The baffle 60, may be removably positioned within the main portion 52 of the delivery nozzle segment 51. The baffle 60 may be supported within the delivery nozzle segment 51 on support flanges 63, between the passages 62, adapted to engage with complementary portions within the delivery nozzle segment 51. In alternative embodiments, the baffle 60 may comprise support flanges 63 extending around the baffle 60, with the passages 62 inward of the support flanges 63. In yet further embodiments, the baffle 60 may comprise centralized passages, the baffle 60 adapted to support a pool of molten metal, within the main portion 52 of the delivery nozzle segment 51 above the baffle 60, on either side of the centralized passages.

Figure 8:
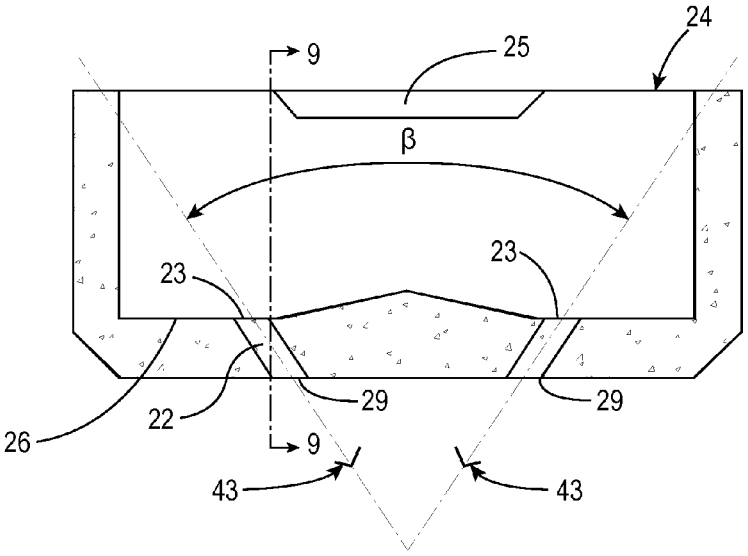
FIG. 8 is a cross-sectional transverse end view taken along the line 8-8 of the metal delivery nozzle of FIG. 2.
Figure 9:
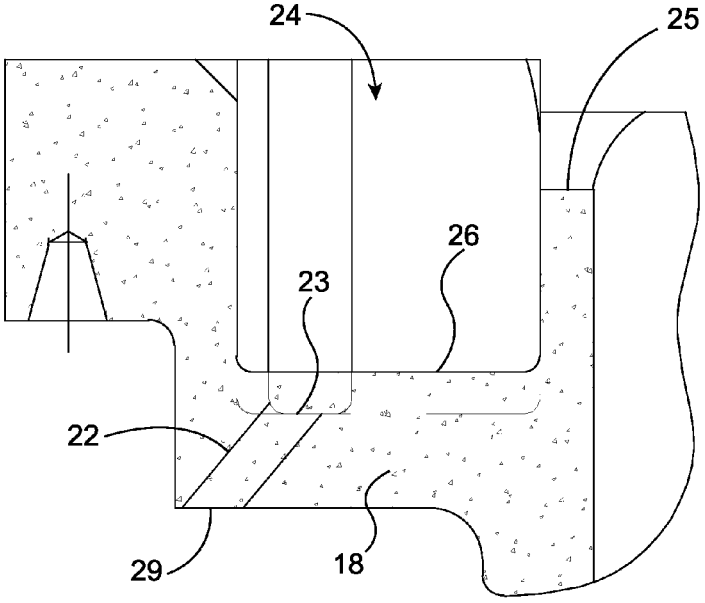
FIG. 9 is a cross-sectional transverse taken along the line 9-9 of the metal delivery nozzle reservoir portion shown in FIG. 8.

FIGS. 8 and 9 show the reservoir portion 24 in the end portion 18 of the segment 13 positioned adjacent one of the ends of the casting rolls 6. The reservoir portion 24 is adapted to deliver molten metal to the casting pool 8 in the area adjacent the side dams at the ends of the casting rolls 6. This area, the "triple point" region, is the area where skulls are more likely to form because of the different heat gradients adjacent a side dam. These skulls grow and eventually drop through the nip 9 of the casting rolls 6. The skulls passing through the nip 9 apply force to the casting rolls 6 causing the casting rolls 6 to move laterally apart. The skulls, with the lateral movement of the casting rolls 6, cause defects in the cast strip. To compensate for the different heat gradients in the "triple point" region, molten metal is directed into the triple point region of the casting pool 8 through slanted passages 22 with inlets 23 and outlets 29 in the reservoir portion 24 positioned in the end portion 18 adjacent side dams (not shown). The shape of the reservoir portion 24 is shown in FIGS. 8 and 9, with a bottom portion 26 shaped to cause the molten metal to flow through slanted passages 22 toward the outlets 29. The reservoir portion 24 in the end portion 18 of each segment 13 may have laterally extending weirs 25 adapted to allow molten metal to flow over the weirs 25 between the reservoir portion 24 and the main portion 17. This allows molten metal to flow between the main portion and the reservoir portion 24 and, in turn, into the "triple point" region, while allowing flow of molten metal from the inner trough 14 concurrently to outlets 20 through the passages 16. The height of the weirs 25 is selected to provide an effective flow of molten metal at a higher effective temperature into the "triple point" region to balance the difference in heat gradient in the "triple point" region.

In some embodiments, the apparatus 2 for continuously casting metal strip may have passages 22 in the reservoir portion 24 of each segment 13, the passages 22 may be angled such that the directions of flow 43 of the at least one pair of passages 22 converge below the reservoir portion 24. The angle of convergence β of the at least one pair of passages 22 may be such that the directions of flow 43 from outlets 29 of the at least one pair of passages 22, converge in the triple point region, at another position within the casting pool 8, above the nip 9, at the nip 9, or at some virtual position below the nip 9. The at least one pair of passages 22 in the reservoir portion 24 may have an angle of convergence β of not less than 5 and not more than 60 degrees substantially centered about the vertical centerline CL through the elongated delivery nozzle 10. In other embodiments, the angle of convergence β may be approximately 66 degrees. Further, to inhibit the washing of the shells forming on the casting surfaces 7 of the casting rolls 6, the at least one pair of passages 22 may be positioned such that they direct molten metal into the casting pool 8 sufficiently away from the casting roll surfaces 7 to reduce washing of shells off of the casting rolls 6. In some embodiments, the at least one pair of passages 22 in the reservoir portion 24 of each segment 13 may be positioned between 40 and 160 millimeters apart. In other embodiments, the at least one pair of passages 22 may be positioned between 50 and 125 millimeters apart. Furthermore, passages 22 may be round or oblate passages having parallel sides. In other embodiments, the passages 22 may be flared or narrowed, further controlling the flow of the molten metal as it flows from the reservoir portion 24 into the triple-point region of the casting pool 8. In yet other embodiments, the passages 22 may be curved or have a change of direction.

Molten metal may be directed from the reservoir portion 24 into the triple point region through slanted passages 22 to outlets 29 in the end portion 18. The reservoir portion 24 having at least one pair of passages 22 with outlets 29 adapted to deliver molten metal into the molten metal pool 8 adjacent the side dams so as to inhibit washing of shells forming on the casting surfaces 7 of the casting rolls 6. In some embodiments, the reservoir portion 24 may have two or more pairs of passages 22. Each of the two or more pairs of passages 22 may be arranged parallel to the other of the two or more pairs of passages or may be arranged having different angles of convergence β than the other of the two or more pairs of passages. As shown in FIGS. 2-6, the inner trough 14 may extend substantially to the end wall of the segment 13 in the end portion 18, with the reservoir portion 24 formed laterally in two parts integral with the side walls 15 of the segment 13. One or more weirs 25 may be provided in the segment 13 to separate the flow of molten metal from the inner trough 14 into the reservoir portions 24 and from there into the "triple point" region of the casting pool 8. It is contemplated that the segment 13 may or may not include such weirs as desired in the particular embodiment.

Referring to FIGS. 10 and 11, an alternative embodiment of the delivery nozzle 10 comprises two segments 13 (one shown), with each segment 13 having opposing side walls 15 and an upward opening inner trough 14, which extend lengthwise along segment 13 in the longitudinal direction through the main portion 17 and into end portion 18 of delivery nozzle 10. Partitions 28 extend between segment side walls 15 at spaced locations along the main portion 17, and provide structural support for the segment 13 of the delivery nozzle 10 when loaded with molten metal in operation. Passages 16 may be formed between the segment side walls 15 and inner trough 14. The passages 16 extend between the partitions 28 or between one partition 28 and an end portion 18 along the length of the segment 13. The passages 16 extend to side outlets 20 at a bottom portion 21 of the segment 13.

In each of the embodiments and alternatives described above, the pair of segments 13 may be assembled lengthwise with the segment end walls 19 in abutting relation and the end portions 18 forming the outer ends of the segment 13 and delivery nozzle 10. Delivery nozzle 10 may comprise a single segment 13, or more than two segments 13, that include all the features of, and effectively functions as, the pair of segments 13 as described herein. Further, segment 13 may include partitions 28, extending between segment side walls 15 to strengthen segment 13 under load of molten metal during a casting campaign. As shown in FIGS. 1A and 1B, each segment 13 includes mounting flanges 27 that extend outward from segment side walls 15, either continuously (as shown in FIGS. 2, 5 and 10) or intermittently, as desired, to mount segments 13 in assembly of the delivery nozzle 10 in the casting apparatus 2. Since the side outlets 20 and the passages 16 extend along both sides of the main portion 17 and into end portion 18 of each segments 13, except at the partitions 28, a relatively uniform flow of molten metal can be provided along the length of the segments 13 (even into the area adjacent the end of the casting rolls 6). Optionally, a nozzle insert may be provided, either as a single unit above or formed around partitions 28, or provided in parts capable of fitting between partitions 28 or between a partition 28 and an end portion 18. The assembly of the segments 13 of the metal delivery nozzle 10 is otherwise generally the same as that described above with reference to FIGS. 2-8.

The end wall or side walls of each inner trough 14 may act as a weir to separate the flow of molten metal into the reservoir 24. Thus, it is contemplated that such an arrangement may not include the weir(s) 25, as shown in FIGS. 2-11. In such a case, the height of the inner trough end wall or side walls is selected to provide most effective flow of molten metal at a higher effective temperature into the reservoir 24 and on to the "triple point" region to normalize the difference in heat gradient in the "triple point" region. The inner trough 14 may be made of any refractory material, such as alumina graphite, the material of the segment 13 or any other material suitable for guiding the flow of incoming molten metal.

Figure 12:
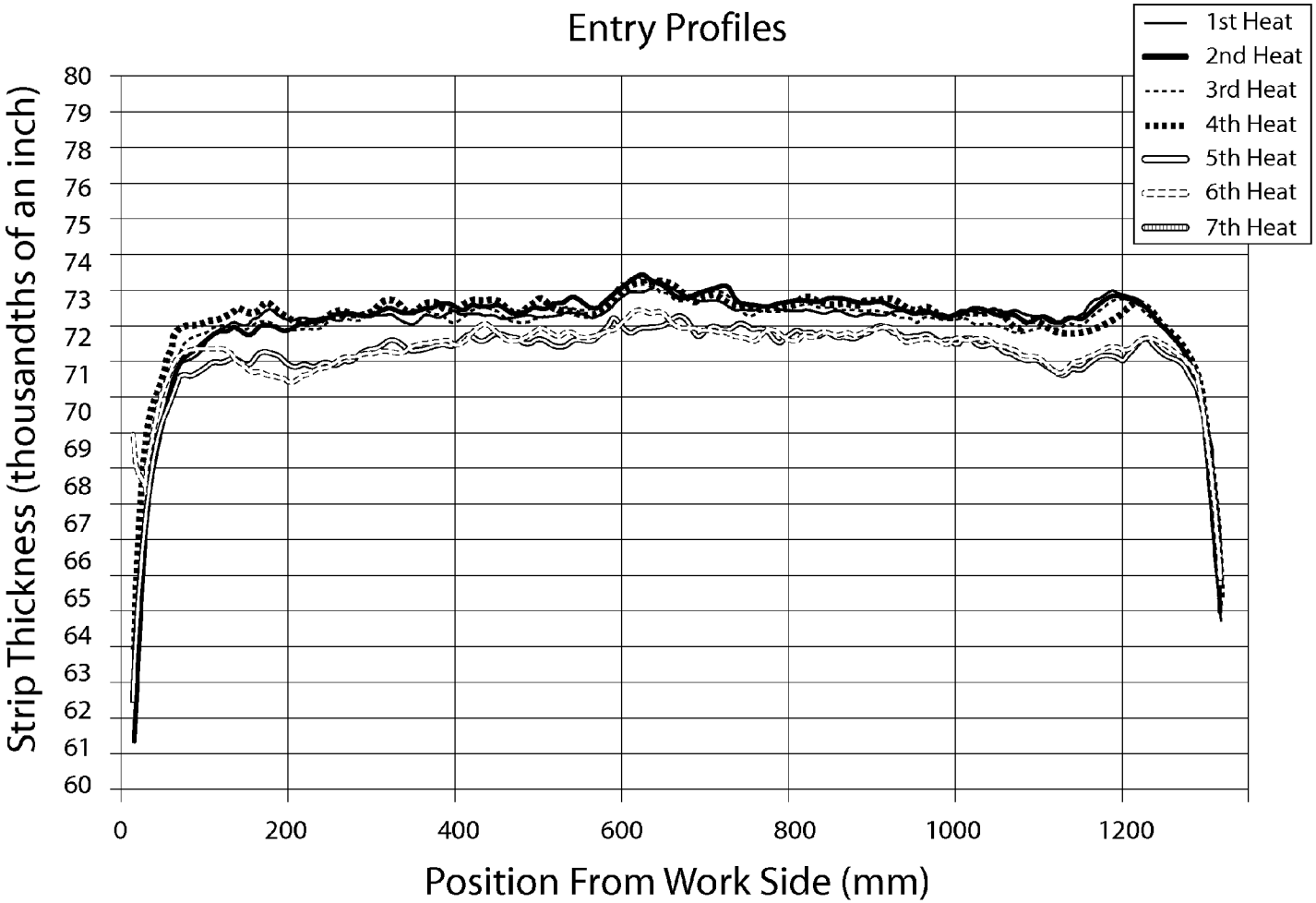
FIG. 12 is a graph showing the strip profile for each heat as the cast strip enters the rolling mill of the continuous casting apparatus
Figure 13:
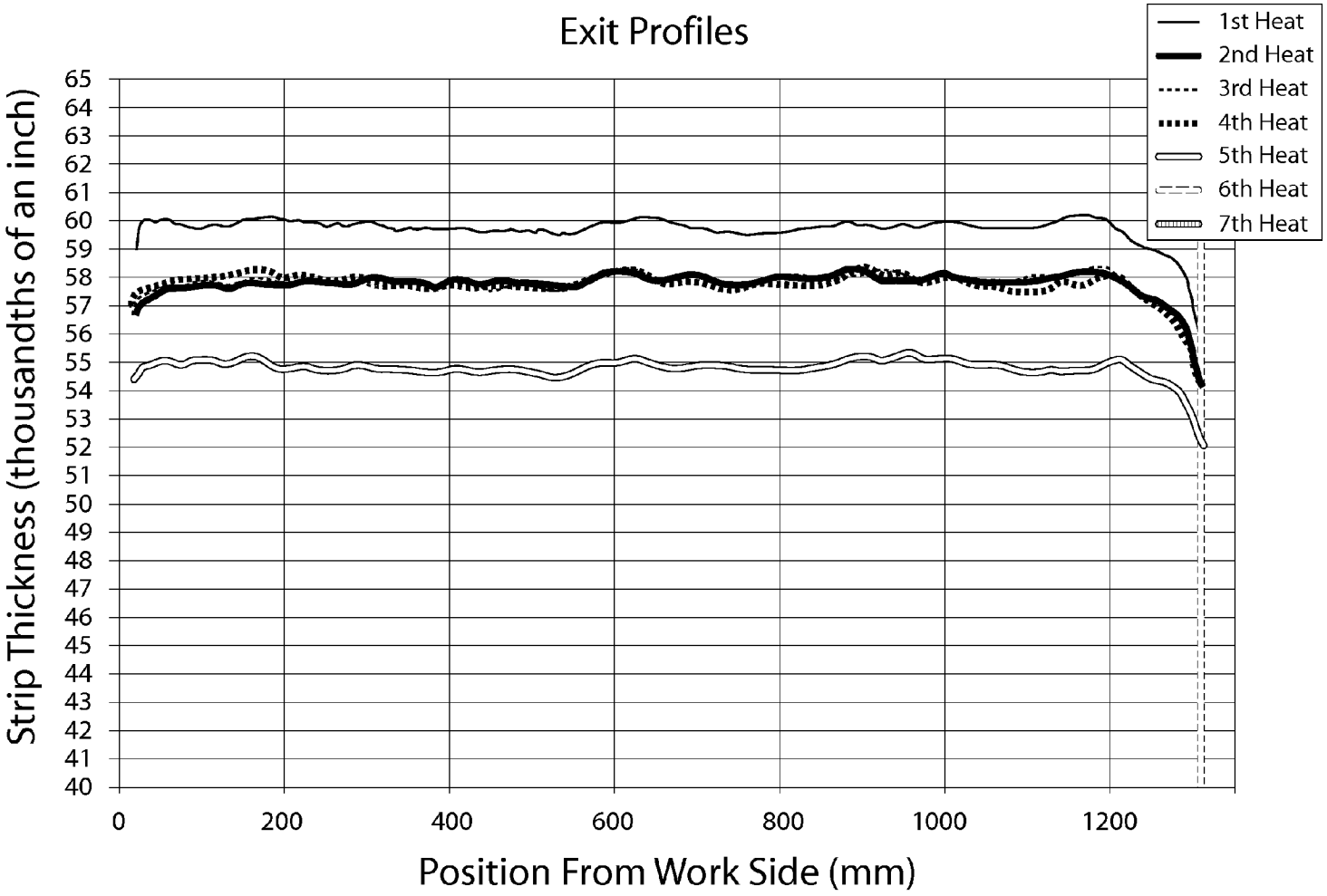
FIG. 13 is a graph showing the strip profile for each heat as the cast strip exits the roll stand of the continuous casting apparatus.

FIG. 12 is a graph showing the strip profile for each of seven heats during a single continuous casting sequence. The graph shows the strip thickness across the width, measured in thousandths of an inch, from one side portion of the strip to the other side portion of the strip, measured prior to entering the rolling mill of a continuous casting apparatus. FIG. 13 is a graph showing the strip thickness across the width, measured in thousands of an inch, from one side portion of the strip to the other side portion of the strip, measured after exiting the rolling mill, for each of the seven heats during the sequence. During the sequence a delivery nozzle 10, comprising a pair of rows of outlets 20 disposed longitudinally along the main portion 17 of the delivery nozzle 10, where the directions of flow from the pairs of outlets 20 converge downwardly toward the nip, as shown in FIGS. 1A-3A. Thus, the graphs show the overall strip profile produced by such a delivery nozzle.

While the principle and mode of operation of this invention have been explained and illustrated with regard to particular embodiments and alternatives, it must be understood, however, that this invention may be practiced otherwise than as specifically explained and illustrated without departing from its spirit or scope.

What is claimed is:

1. An apparatus for continuously casting metal strip comprising:

(a) a pair of casting rolls laterally positioned to form a nip between them and side dams to form a molten metal pool supported by the casting rolls between the side dams and adapted to counter rotate to form shells on the casting rolls brought together at the nip to cast metal strip downwardly from the nip, (b) an elongated metal delivery nozzle extending along and above the nip, the delivery nozzle having one or more segments each having:

a main portion extending along the elongated metal delivery nozzle with a plurality of outlets positioned longitudinally along the elongated metal delivery nozzle and directed converging downwardly toward the nip while forming the casting pool of molten metal supported on the casting rolls above the nip, and an end portion adjacent the side dams having a reservoir portion having at least one pair of passages adapted to deliver molten metal into a molten metal pool adjacent the side dams with flow from the at least one pair of passages converging below the reservoir portion; and, (c) a metal delivery system adapted to introduce molten metal through the segments of the elongated metal delivery nozzle downwardly converging toward the nip.

2. The apparatus for continuously casting metal strip as claimed in claim 1 where the outlets in the main portion of each segment are arranged in a pair of rows of outlets and deliver molten metal with flow from each row of outlets converging toward flow from the other row of outlets.

3. The apparatus for continuously casting metal strip as claimed in claim 1 where the outlets in the main portion of each segment configured at an angle between 5 and 60 degrees substantially centered about a vertical centerline through the elongated delivery nozzle.

4. The apparatus for continuously casting metal strip as claimed in claim 2 where the pairs of rows of outlets in the main portion of each segment are angled such that their directions of flow converge below the delivery nozzle.

5. The apparatus for continuously casting metal strip as claimed in claim 1 where the reservoir portion in the end portion of each segment has laterally extending weir adapted to allow molten metal to flow over the weirs between the reservoir portion and the main portion.

6. The apparatus for continuously casting metal strip as claimed in claim 1 where the main portion of each segment extends beneath the reservoir portion into the end portion of each segment.

7. The apparatus for continuously casting metal strip as claimed in claim 1 where the at least one pair of passages in the reservoir portion of each segment are angled such that their directions of flow converge below the reservoir portion.

8. The apparatus for continuously casting steel strip as claimed in claim 7 where the at least one pair of passages in the reservoir portion have an angle of convergence between 5 and 60 degrees substantially centered about a vertical centerline through the elongated delivery nozzle.

9. The apparatus for continuously casting metal strip as claimed in claim 1 where entries of each passage of the at least one pair of passages in the reservoir portion are positioned between 40 and 160 millimeters apart.

10. The apparatus for continuously casting metal strip as claimed in claim 1 where entries of each passage of the at least one pair of passages in the reservoir portion of each segment are positioned between 50 and 125 millimeters apart.

11. The apparatus for continuously casting steel strip as claimed in claim 1 where the one or more outlets is a channel extending longitudinally along each segment.

12. The apparatus for continuously casting steel strip as claimed in claim 11, where the channel has substantially parallel sides.

13. The apparatus for continuously casting steel strip as claimed in claim 11, where the channel has tapered sides.

14. The apparatus for continuously casting steel strip as claimed in claim 1, where the delivery nozzle has a restrictive baffle in the main portion adapted to cause the molten metal to flow laterally within the delivery nozzle.

15. The apparatus for continuously casting steel strip as claimed in claim 14, where the restrictive baffle is adapted to support a pool of molten metal in the main portion of the delivery nozzle.

16. The apparatus for continuously casting steel strip as claimed in claim 1, where the restrictive baffle is adapted to reduce the velocity of the molten metal passing through the delivery nozzle.

17. The apparatus for continuously casting steel strip as claimed in claim 1, where the main portion has one or more passages above the one or more outlets, adapted to deliver molten metal to the outlets.

18. The apparatus for continuously casting steel strip as claimed in claim 17, where a bottom portion of the main portion is tapered toward the one or more passages.

19. The apparatus for continuously casting steel strip as claimed in claim 1, where a bottom portion of the main portion is tapered toward the one or more outlets.

* * * * *